United States Patent [19]

Stout et al.

[11] 4,374,561

[45] Feb. 22, 1983

[54] ARTICLE CARRIER

[75] Inventors: James T. Stout, Acworth; Prentice J. Wood, Hapeville, both of Ga.

[73] Assignee: The Mead Corporation, Dayton, Ohio

[21] Appl. No.: 310,894

[22] Filed: Oct. 13, 1981

[51] Int. Cl.[3] ..... B65D 5/48

[52] U.S. Cl. ..... 206/188; 206/193; 229/28 BC; 229/52 BC; 229/15

[58] Field of Search ..... 206/174, 175, 188, 189, 206/190, 191, 193; 229/28 BC, 52 BC, 15

[56] References Cited

U.S. PATENT DOCUMENTS

| | | | |
|---|---|---|---|
| 2,711,844 | 6/1955 | Buttery et al. | 206/188 |
| 3,568,880 | 3/1971 | Harrelson | 206/188 |
| 3,857,483 | 12/1974 | Wood | 206/187 |
| 4,117,925 | 10/1978 | Wood | 229/28 BC |
| 4,243,138 | 1/1981 | Wilson | 206/188 |

*Primary Examiner*—Joseph Man-Fu Moy
*Attorney, Agent, or Firm*—Rodgers & Rodgers

[57] ABSTRACT

An article carrier comprising a bottom panel with side walls and end panels upstanding therefrom, riser panels joined to the end panels respectively, a handle joined to the riser panels, a medial keel panel formed integrally with each riser panel at one end of the carrier and projecting inwardly therefrom, a first transverse partition panel joined to one keel panel and extending to one side wall, a second transverse partition panel connected to the other keel panel and extending to the other side wall, a reinforcing tab joined to the other keel panel and being disposed in flat face contacting relation with the first transverse partition panel, a series of cuts formed along a junction between the reinforcing tab and the other keel panel, and an aperture formed astride the fold line between the first transverse partition panel and the one keel panel.

7 Claims, 10 Drawing Figures

ARTICLE CARRIER

TECHNICAL FIELD

This invention relates to article carriers in which the natural resistance to bending of multiple plys of carrier paperboard material is effectively reduced in order to enable easy manipulation of the carrier into a fully set up and stable condition.

BACKGROUND ART

Prior art which relates to this invention is disclosed in U.S. Ser. No. 150,991 filed May 19, 1980 and U.S. Pat. No. 1,436,066.

DISCLOSURE OF THE INVENTION

According to this invention an article carrier is provided and comprises a bottom panel with upstanding side walls and end panels, riser panels joined to the end panels respectively, a multi-ply handle connected to the riser panels, medial keel panels formed integrally with each riser panel at one end of the carrier, a first transverse partition panel foldably joined to one of the keel panels, a second transverse partition panel joined to the other keel panel, a reinforcing tab joined to the other keel panel and being disposed in flat face contacting relation with the first transverse partition panel, at least one cut formed along the junction between the reinforcing tab and the other keel panel, and an aperture formed astride the fold line between the first transverse partition panel and the one keel panel.

BEST MODE OF CARRYING OUT THE INVENTION

Figure 1:
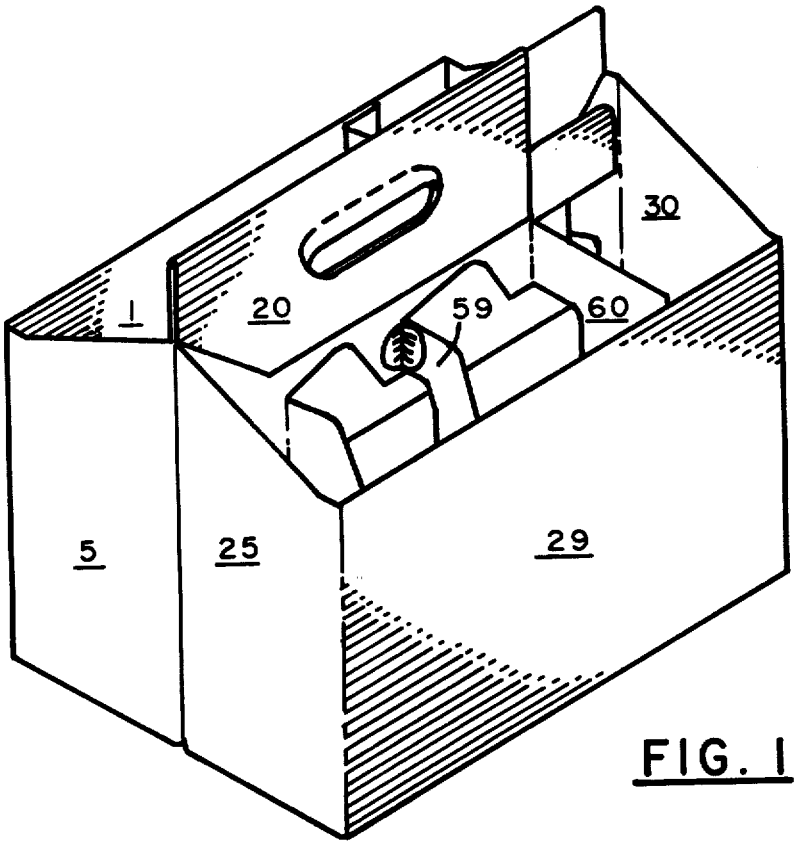
FIG. 1 is a perspective view of an article carrier formed according to this invention.

In the drawings the numeral 1 designates a side wall to the bottom edge 2 of which a bottom panel 3 is foldably joined. Bottom panel 3 is provided with a medial fold line 4. End panel 5 is foldably joined to side wall 1 along fold line 6 while end panel 7 is foldably joined to side wall 1 along fold line 8. Riser panel 9 is foldably joined to end panel 5 along fold line 10 while riser panel 11 is foldably joined to end panel 7 along fold line 12.

The handle of the carrier is of the multi-ply type and includes an outer panel 13 foldably joined to riser panel 9 along fold line 10 and having hand gripping aperture 14 formed therein. Inner handle panel 15 is foldably joined to riser panel 11 along fold line 16. An anchoring tab 17 is foldably joined to side wall 1 along fold line 17*a* and a transverse partition element 18 is foldably joined to anchoring tab 17 along fold line 19.

The other side of the carrier includes outer handle panel 20 foldably joined to outer handle panel 13 along medial fold line 21. Hand gripping aperture 22 is formed in outer handle panel 20. Inner handle panel 23 is foldably joined along fold line 21 to inner handle panel 15 and hand gripping aperture 24 is formed in inner handle panel 23.

End panel 25 is foldably joined to outer handle panel 20 and to riser panel 28 along fold line 26 and is foldably joined along fold line 27 to one end of side wall 29. Lap panel 29*a* is formed to the lower edge of side wall 29 along fold line 29*b*. End panel 30 is foldably joined along fold line 31 to the other end of side wall 29 and riser panel 32 is foldably joined to end panel 30 along a fold line 33. Inner handle panel 23 is joined to riser panel 32 along fold line 34. Conventional locking notches 35–38 are formed respectively in riser panels 28, 32, 9 and 11.

The longitudinal and transverse partition structure for the carrier includes a medial keel panel 40 which is formed integrally with riser panel 9. Medial anchoring structure generally designated by the numeral 41 is foldably joined to medial keel panel 40 along fold lines 42, 43 and 44. Transverse partition panel 45 is foldably joined to medial anchoring structure 41 along fold line 46 while transverse partition panel 47 is foldably joined to medial anchoring structure 41 along fold lines 48 and 49. A glue flap 50 is foldably joined to the outer edge of transverse panel 45 along fold line 51 and a similar glue flap 52 is foldably joined to the outer edge of transverse panel 47 along fold line 53. Transverse partition panel 54 is foldably joined to medial anchoring structure 41 along fold lines 55 and 56.

The partition structure on the other side of the carrier includes medial keel panel 57 which is integrally formed with riser panel 28 and which projects medially inward of the carrier when the carrier is set up and includes transverse panels 58, 59 and 60. Transverse partition panel 58 is foldably joined to medial keel panel 57 along fold line 61 while transverse partition panel 59 is foldably joined to keel panel 57 along fold line 62 and interrupted fold line 63. Transverse partition panel 60 is foldably joined to medial keel panel 57 along fold lines 64 and 65. Glue flap 66 is foldably joined to transverse partition panel 58 along fold line 67 while glue flap 68 is foldably joined to transverse partition panel 59 along a fold line 69 and glue flap 70 is foldably joined to transverse partition panel 60 along fold lines 71 and 72. Medial strut panel 73 is foldably joined to medial keel panel 57 along fold line 74.

According to a feature of this invention, reinforcing tab 75 is joined to medial keel panel 40 along a series of angular cuts C. For the purpose of cooperating with angular cuts C, circular aperture 76 is formed astride interrupted fold line 63.

Figure 2:
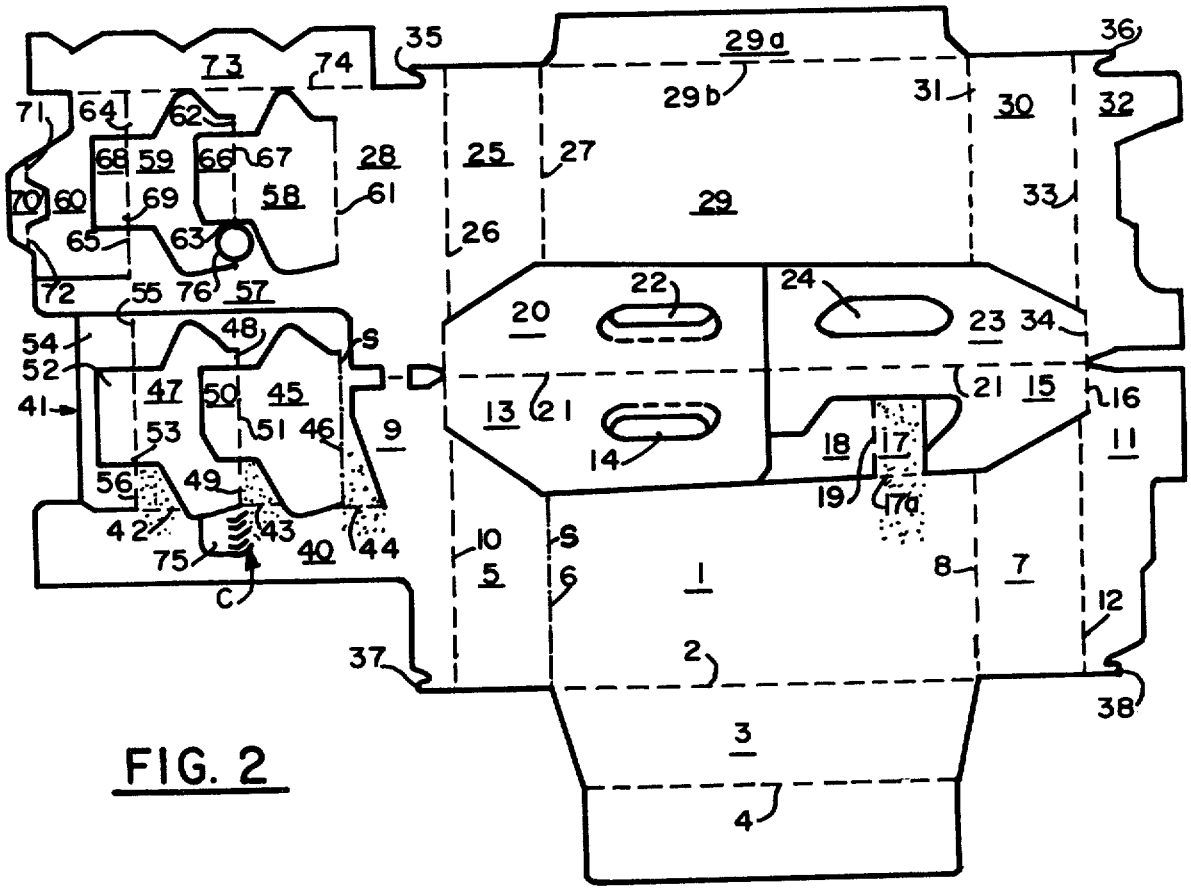
FIG. 2 is a plan view of a blank from which the carrier is formed.
Figure 3:
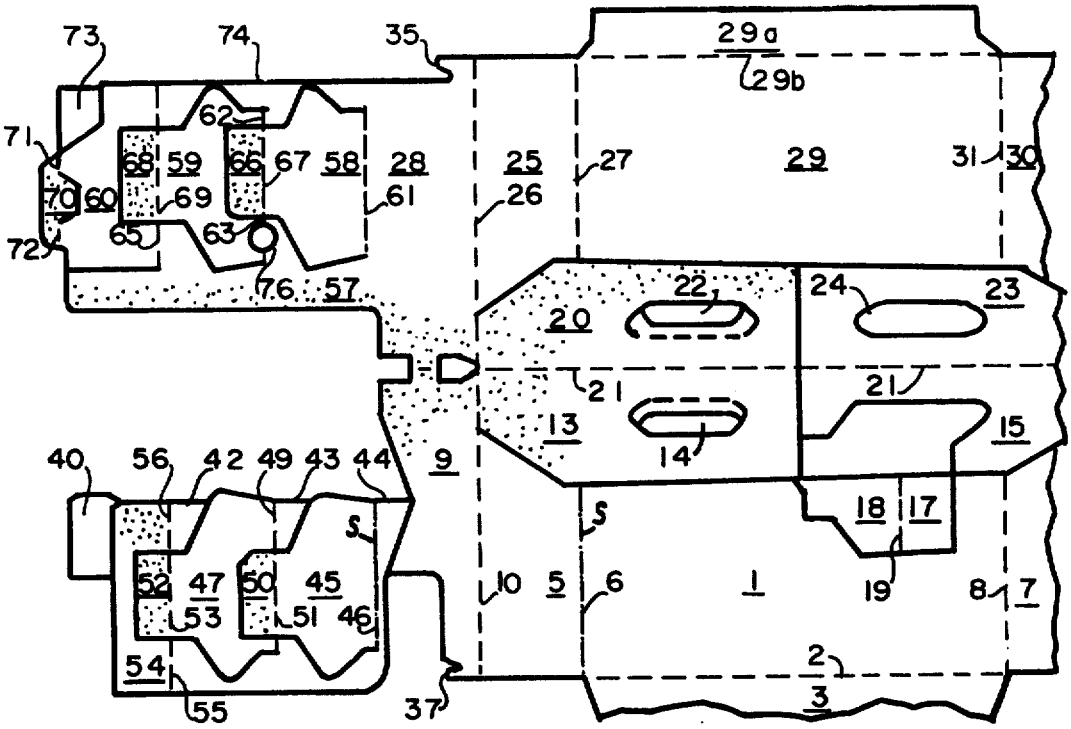
FIGS. 3, 4, 5, and 6 depict intermediate stages through which the blank is manipulated and glued in order to form a complete and collapsed carrier as shown in FIG. 7.

In order to form the carrier from the blank as depicted in FIG. 2, applications of glue are first made to the blank as indicated by stippling in FIG. 2. Thereafter medial anchoring structure 41 is elevated and folded forwardly along fold lines 42, 43 and 44 to occupy the position indicated in FIG. 3. This operation causes those portions of medial anchoring structure 41 which are adjacent the fold lines 42, 43, and 44 to become adhered to those portions of medial keel panel 40 which are adjacent fold lines 42, 43 and 44. In like fashion anchoring tab 17 and transverse partition element 18 are elevated and folded forwardly to occupy the positions indicated in FIG. 2. This operation causes the anchoring tab 17 to adhere to the inner surface of the side wall 1. Also medial strut panel 73 is folded rearwardly and downwardly along fold line 74. The blank then appears as shown in FIG. 3.

Figure 4:
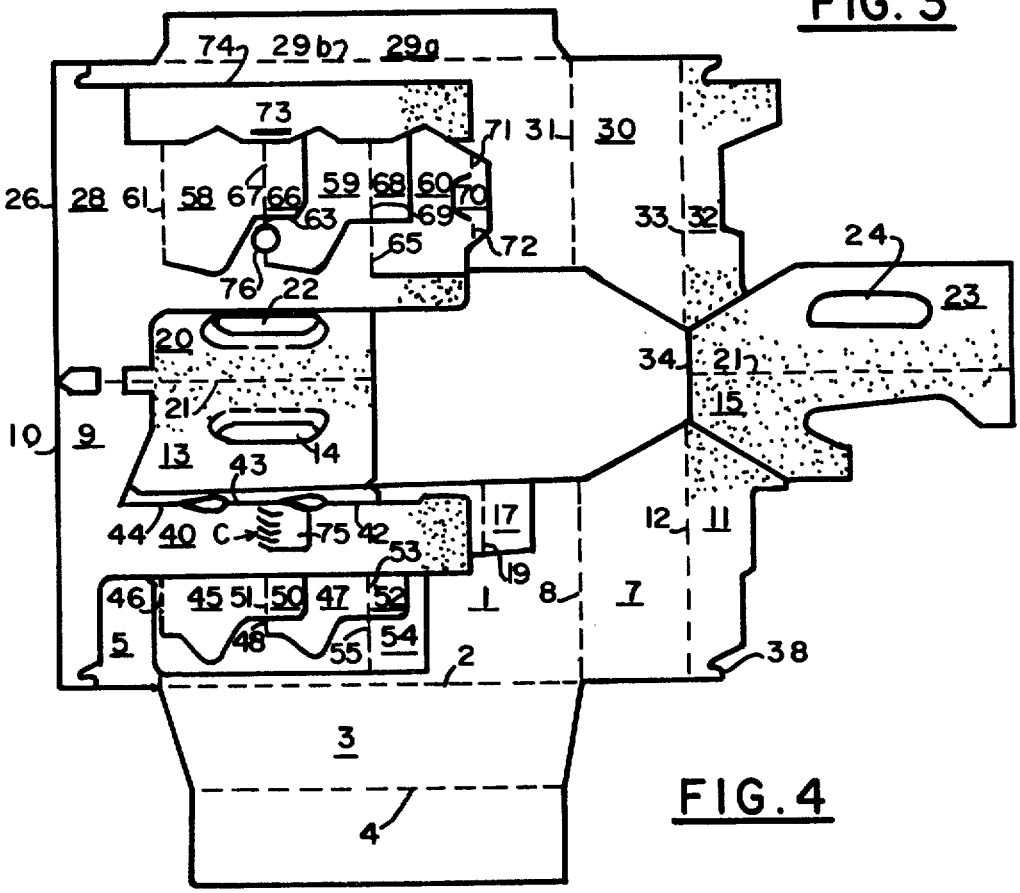

Thereafter glue is applied to riser panels 11 and 32. Then inner handle panels 23 and 15 are elevated and folded toward the right along fold lines 34 and 16 respectively to occupy the positions indicated in FIG. 4 to cause inner handle panels 23 and 15 to adhere to riser panels 32 and 11 respectively. An application of glue is made to other parts of the blank as indicated by stippling in FIG. 3. Riser panels 9 and 28 as well as medial keel panels 40 and 57 and all the structures associated therewith including medial strut panel 73 are elevated and folded toward the right along fold lines 10 and 26. This operation causes the blank to appear as indicated in FIG. 4. After folding into the position represented by FIG. 4, riser panel 9 is adhered to the inner surface of outer handle panel 13 and glue flaps 50 and 52 are adhered to side wall 1. Simultaneously the upper end of transverse panel element 54 becomes adhered to transverse panel element 18. In similar fashion riser panel 28 and medial keel panel 57 become adhered to the inner surface of outer handle panel 20 and glue flaps 66, 68, and 70 become adhered to the inner surface of side wall 29 and the blank appears as indicated in FIG. 4.

Figure 5:
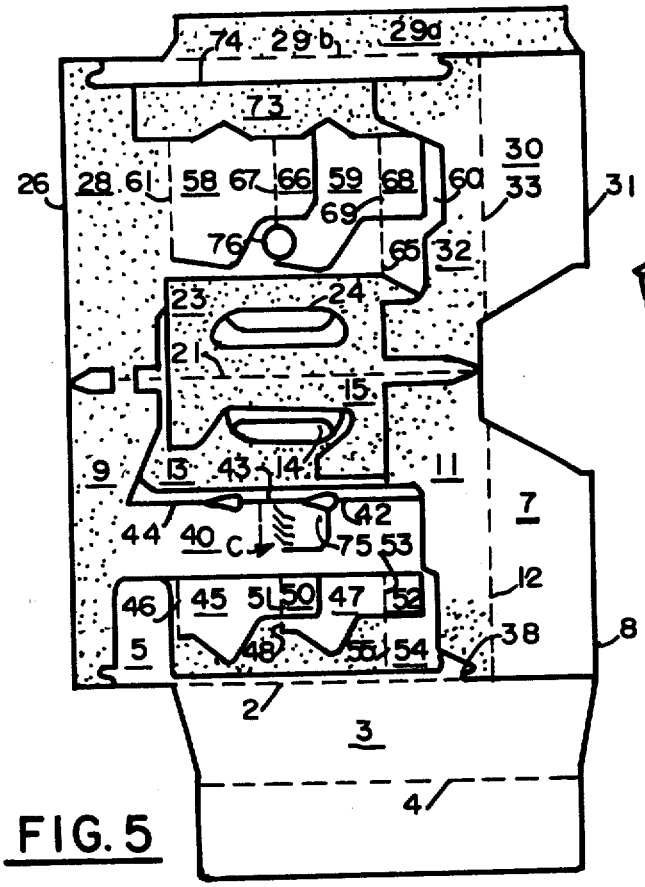
Figure 8:
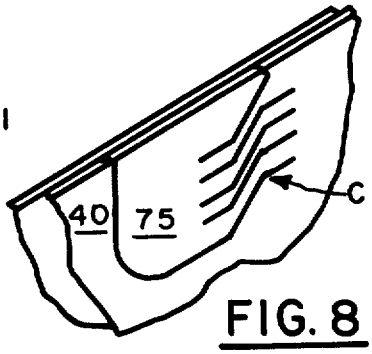
FIGS. 8, 9 and 10 are fragmentary views showing a portion of the carrier transverse partition structure.
Figure 9:
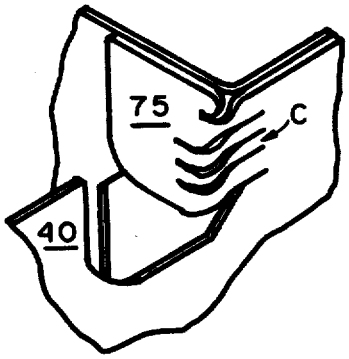
Figure 6:
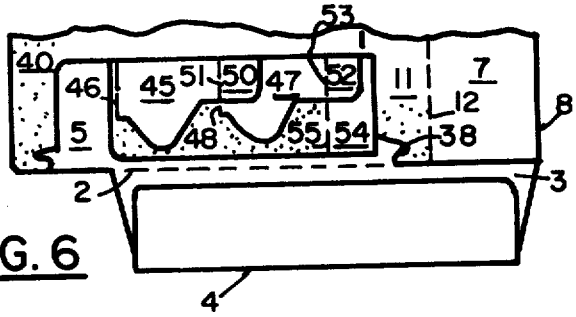
Figure 10:
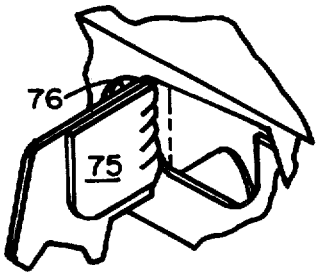

An application of glue is then made to the blank as indicated by stippling in FIG. 4 and end wall panels 7 and 30, riser panels 11 and 32 as well as inner handle panels 15 and 23 are elevated and swung toward the left along fold lines 8 and 31. Upon completion of this folding operation the blank appears as indicated in FIG. 5. The completion of this folding operation causes the riser panel 32 to adhere to the right hand end of medial strut panel 73 and to the right hand end of medial keel panel 57. In like fashion riser panel 11 is adhered to the right hand end of medial keel panel 40. Inner handle panels 15 and 23 become adhered respectively to the inner surfaces of outer handle panels 13 and 20. Then the lower portion of bottom panel 3 is elevated and folded over along medial fold line 4 as shown in FIG. 6.

Figure 7:
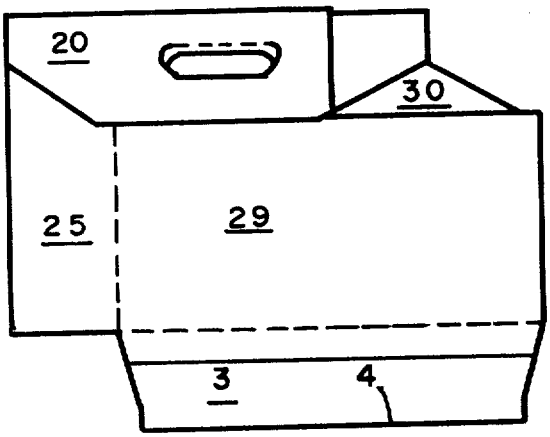

An application of glue is then made as indicated by stippling in FIG. 5 and those portions of the blank which are disposed above the medial fold line 21 are elevated and folded forwardly so that the blank then appears as indicated in FIG. 7. This latter folding operation causes riser panels 9 and 28 to become adhered to each other in face contacting relation and also causes riser panels 11 and 32 to become adhered to each other in face contacting relation. Medial strut panel 73 is adhered to the lower portions of medial anchoring structure 41 and inner handle panels 15 and 23 become adhered to each other. Lap panel **29*a* becomes adhered to bottom panel 3 and the carrier appears in complete and collapsed form as indicated in FIG. 7**.

In order to set the carrier up from the condition represented in FIG. 7 to that represented by FIG. 1, end panels 25 and 5 are held against movement toward the left and a force is applied to the right hand edges of side walls 29 and 1. This operation, in known manner, causes the side walls 29 and 1 to swing transversely outward and aligns the end panels 25 and 5 with each other as well as the end panels 7 and 30 with each other. Locking notches 35, 37 and 36, 38 engage bottom panel 3 at the ends of fold line 4 and the carton remains in set up condition as represented in FIG. 1.

When the carrier is folded and glued, reinforcing tab 75 is adhered to transverse panel 59. Since this in effect causes two panels disposed in flat face contacting relation to fold simultaneously around a pair of coincidental fold lines, an excessive amount of force is required to set up the carrier. Therefore, by this invention, cuts C in combination with aperture 76 effectively reduce the force required to bend reinforcing tab 75 and transverse panel 59 through 90° angles as is required to completely set up the carrier. In fact the angular shape of cuts C causes them to, in affect, spread apart when the carrier is set up and actually allows reinforcing panel 75 to separate somewhat from medial keel panel 40.

As best shown in FIG. 2, fold lines 6 and 46 are weakened by means of a series of slits S disposed along the lengths thereof. This reduces the inherent fight in the paperboard material and allows the carrier easily to remain in a fully set up and square condition.

INDUSTRIAL APPLICABILITY

By this invention a carrier is provided which is easily manipulated and caused to stay in a fully set up and essentially square condition.

I claim:

1. An article carrier comprising a bottom panel, opposed side walls foldably joined to opposite side edges of said bottom panel, end panels foldably joined to the ends of said side walls and extending transversely inward therefrom, riser panels foldably joined to said end panels respectively, the riser panels at each end of the carrier being secured together in face contacting relation, a multi-ply handle connected at its ends to said riser panels, a medial keel panel formed integrally with each riser panel at one end of the carrier and projecting inwardly therefrom, a transverse partition panel foldably joined to one of said keel panels and arranged with its outer edge anchored to one of said side walls, a reinforcing tab joined to the other of said keel panels and disposed in flat face contacting relation with said transverse partition panel, at least one cut formed along the junction behind said reinforcing tab and said other keel panel, and an aperture formed astride the fold line between said transverse partition panel and said one keel panel.

2. An article carrier according to claim 1 wherein a series of cuts are formed along said junction.

3. An article carrier according to claim 2 wherein said cuts are angular.

4. An article carrier according to claim 1 wherein said aperture is circular.

5. An article carrier according to claim 1 wherein said cut and said aperture are essentially coincidental.

6. An article carrier according to claim 1 wherein multiple slits are disposed along the fold line between the end panel and side wall at one end of the carrier.

7. An article carrier according to claim 1 wherein multiple slits are disposed along the fold line between said transverse partition panel and said one keel panel.

* * * * *